United States Patent [19]

Williams

[11] Patent Number: 4,969,068

[45] Date of Patent: Nov. 6, 1990

[54] DEVICE FOR WRITING IN THE DARK

[76] Inventor: Dean C. Williams, P.O. Box 50156, Santa Barbara, Calif. 93150

[21] Appl. No.: 393,974

[22] Filed: Aug. 14, 1989

[51] Int. Cl.[5] ..... F21V 33/00

[52] U.S. Cl. ..... 362/99; 206/472

[58] Field of Search ..... 206/472; 362/99, 98

[56] References Cited

U.S. PATENT DOCUMENTS

| | | | |
|---|---|---|---|
| 1,166,930 | 1/1916 | Petrie . | |
| 1,202,498 | 10/1916 | Findley | 362/99 |
| 1,279,820 | 9/1918 | Brassard . | |
| 1,320,537 | 11/1919 | Dimond | 362/99 |
| 1,985,335 | 12/1934 | Bloss | 362/99 |
| 2,054,459 | 9/1936 | Burt | 362/99 X |
| 2,068,813 | 1/1937 | Morey | 362/99 X |
| 2,199,311 | 4/1940 | Hartmann et al. | 240/6.4 |
| 2,629,043 | 2/1953 | Holtje | 362/99 |
| 3,321,616 | 5/1967 | Adler | 362/99 X |
| 4,184,194 | 1/1980 | Shofu | 362/97 |
| 4,266,164 | 5/1981 | Schroeder | 315/169.1 |

FOREIGN PATENT DOCUMENTS

| | | | |
|---|---|---|---|
| 783450 | 4/1935 | France | 362/98 |
| 1208683 | 9/1959 | France | 362/98 |

*Primary Examiner*—Allen M. Ostrager

*Attorney, Agent, or Firm*—R. Dabney Eastham

[57] ABSTRACT

A device is provided for writing in the dark which has the external appearance of a book. Inside the book, a box is attached to the inside of one of the covers. The box contains a continuous strip paper supply which is drawn from underneath an illuminated translucent panel through channels that lead the paper over the translucent panel and under a lid which guides the paper across the pane so that the paper may be drawn out from the box. The lid has an opening through which the user may write on the paper. When in use, the box provides sufficient light so that the user can see to write on the paper yet does not provide so much light that others attempting to sleep nearby are disturbed. The covers may be folded over the box to give the device the appearance of a book.

19 Claims, 2 Drawing Sheets

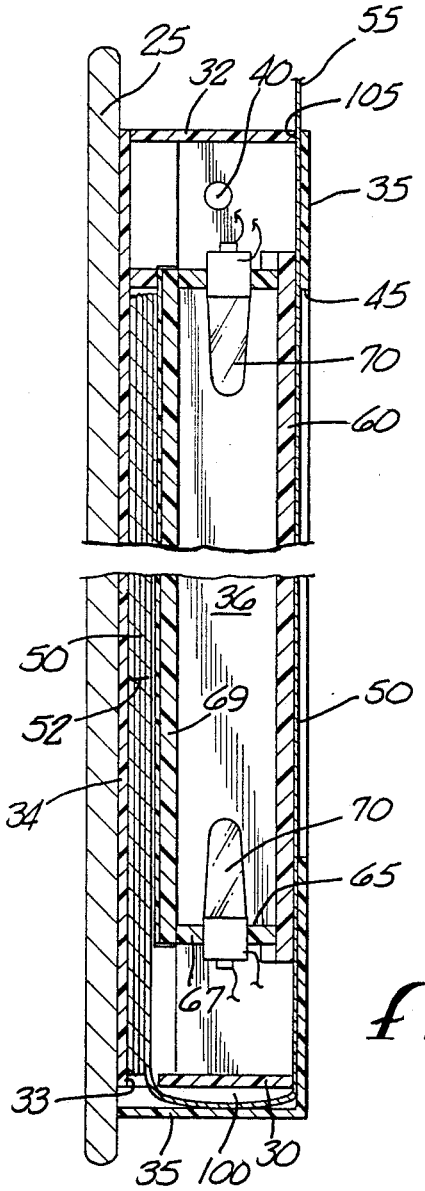
FIG. 4.
FIG. 5.
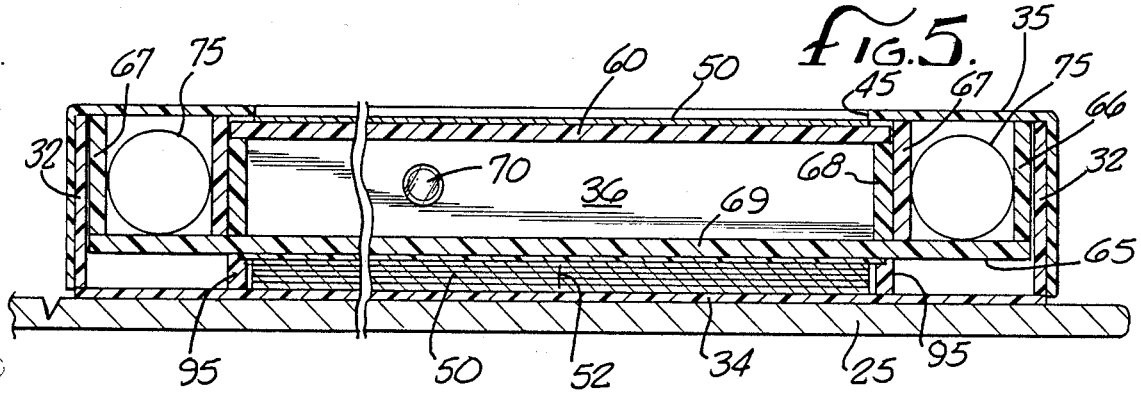

DEVICE FOR WRITING IN THE DARK

BACKGROUND OF THE INVENTION

1. Field of the Invention

The field of the invention is that of illumination. More particularly, the field of the invention is that of devices which permit persons to read and write in conditions of insufficient ambient light without disturbing others.

2. Description of Related Art

Devices are known which permit persons to read and write in the absence of ambient light. Specifically, devices are known which permit the operations of reading and writing without providing more illumination than is required for these purposes. Reading and writing in the dark without the provision of superfluous illumination may be necessary in wartime, when light discipline must be imposed to prevent detection by the enemy. An example of a device constructed for writing messages in time of war is that of Holtje, U.S. Pat. No. 2,629,043. Holtje discloses an illuminated message case which comprises a case enclosing a light source, a lucite panel, and a cellulose film having an opaque wax coating upon which the message is to be written. The Holtje device is essentially a light box in which the writing film is drawn from a built-in roller across a lucite panel which is illuminated from underneath by a battery-powered flashlight bulb.

Another device for writing in the dark designed for military purposes is that of Brassard, U.S. Pat. No. 1,279,820. Brassard discloses an illuminated note pad which consists of a casing which holds paper in position to be written on and simultaneously illuminates the paper without permitting the illumination to attract the attention of a hostile observer. A spool carries a double roll of writing paper which is drawn across a translucent plate. The translucent plate is illuminated from below by an electric lamp and reflector.

Other battery-powered light boxes which illuminate paper or cellulose film by shining light through the paper from underneath are known that are not intended for military purposes. Examples are Shofu, U.S. Pat. No. 4,184,194 and Hartmann, et al., U.S. Pat. No. 2,199,311. Shofu discloses a self-energized portable high-intensity light display unit for displaying transparencies such as x-ray films and photographic films. Hartmann, et al. disclose a map holding box containing a paddle adapted to carry a flashlight bulb and a battery for illumination of a map attached to the face of the box.

Petrie, U.S. Pat. No. 1,166,930, discloses a telescopic combined portable flashlight and writing pad which uses a pocket flashlight supplemented by a sliding sheet metal sheet holding a writing plate made of celluloid or other transparent material. The device of Petrie is intended to illuminate a sheet or scrap of paper so that it may be written upon in the dark without emitting any extraneous light and attracting attention.

Dimond, U.S. Pat. No. 1,320,537, discloses a portable illuminated sketching or writing device having a flat desk or writing surface which is preferably formed of a plate of glass, removeably carried by a suitable casing or housing in which is positioned a reflector plate, which curves upwardly from the plate of glass at one end of the housing for diffusing the light rays from a battery-powered light bulb carried by the housing at the end remote from the curved end of the reflector. The housing provides a compartment in the housing for retaining paper or other sketching materials.

Schroeder, U.S. Pat. No. 4,266,164, discloses an electro-luminescent panel assembly for use in darkness or dim light in which side-by-side light strips form an integrated light field. Non-lighted regions function as dark guidelines to guide writing on overlying sheets of material through which the integrated luminescent field is visible upon energization of the light strips.

As the references discussed above indicate, devices are needed for reading and writing in the dark and which can accomplish this purpose without emitting so much light that hostile attention is attracted. The purposes of such a device do not have to be warlike; passengers travelling in a darkened aircraft at night may wish to write notes to themselves without disturbing their companions; likewise persons writing in bed may wish to do so without awakening their bedmates.

The devices that have been devised for writing in the dark usually are clumsy, expensive, heavy, or difficult to build and use. A need exists for an improved device for writing in the dark without disturbing others.

SUMMARY OF THE INVENTION

Accordingly, an object of the present invention is to provide a simple, inexpensive, compact, lightweight, self-contained, and portable device for writing in the dark without disturbing other persons and which is provided with its own paper supply.

The present invention provides such a device. It is a simple, economical, self-contained, and compact device for writing in the dark which does not emit more light than is needed for the purpose of writing and thus will not provide an annoying level of light even to persons adjacent to the user of the device.

According to the invention, illumination means are provided to illuminate a continuous paper strip drawn from a paper supply means located underneath the illumination means. The illumination means and paper supply means are contained within and positioned with respect to each other by a casing which may be box-like. The writing device may be attached to one of two hingeably joined covers so that the device will appear to be a book when the covers are folded together over the device, which lends an attractive appearance and convenience of transportation and storage (e.g., on a book shelf) to the overall device.

In a preferred embodiment of the invention, an open-faced box defines a first open cavity into which is placed an illumination means; space is provided between the illumination means and the bottom of the box for a paper supply consisting of a continuous sheet of paper such as computer print-out paper. The box has a detachable lid in which an opening sized to fit over the illumination means is formed. A translucent pane is located above the illumination means and below the continuous sheet of paper feeds through channels between the illumination means and the box, over the translucent pane and under the lid and the opening in the lid, and thence out of the box through another channel. The user writes on the paper through the opening in the lid. The paper is illuminated from underneath by the illumination means. After a note is written, the paper is drawn from the box and then detached by tearing or ripping. The illumination means preferably contains a self-contained power means such as batteries, although other power sources may be used.

The invention has low power requirements and can have a simple and safe construction which is portable as well as thin and light.

Other objects and structural features which are believed to be characteristic of the invention are set forth with particularity in the appended claims. The invention, however, may be best understood by reference to the following detailed description taken in connection with the accompanying drawings.

BRIEF DESCRIPTION OF THE DRAWINGS

FIG. 4 is a cross-sectional view of the preferred embodiment of the device according to the invention taken along lines 4—4 in FIG. 1; and FIG. 5 is a cross-section of the preferred embodiment of the device according to the invention taken along lines 5—5 in FIG. 1.

DETAILED DESCRIPTION OF THE PREFERRED EMBODIMENT

Figure 1:
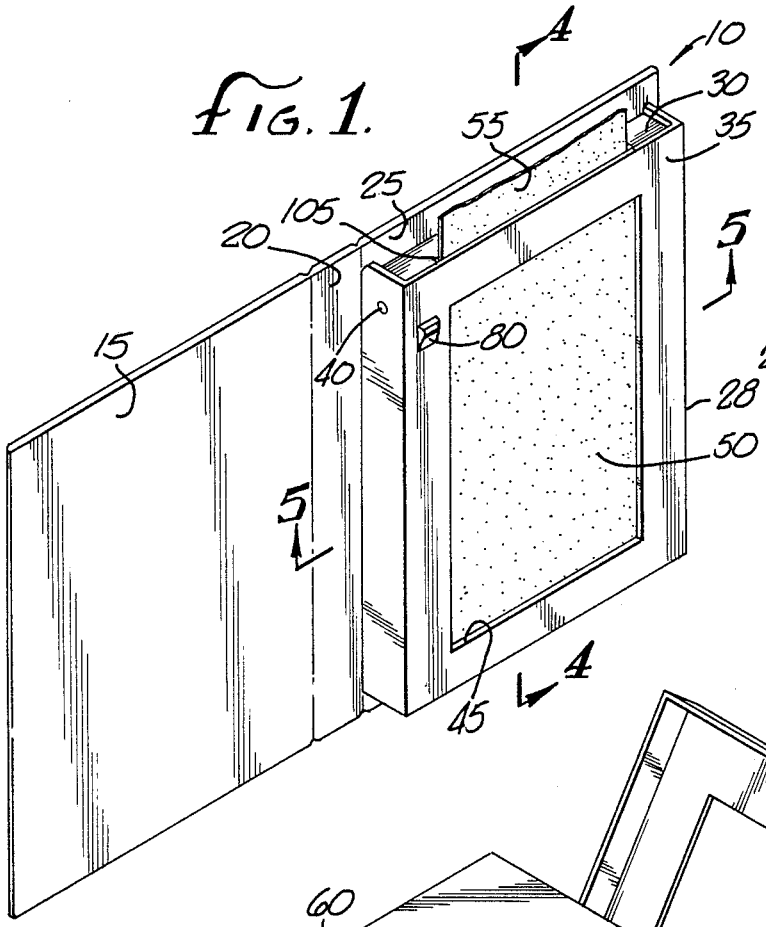
FIG. 1 is a perspective view of a preferred embodiment of the device according to the invention with the covers spread open.
Figure 2:
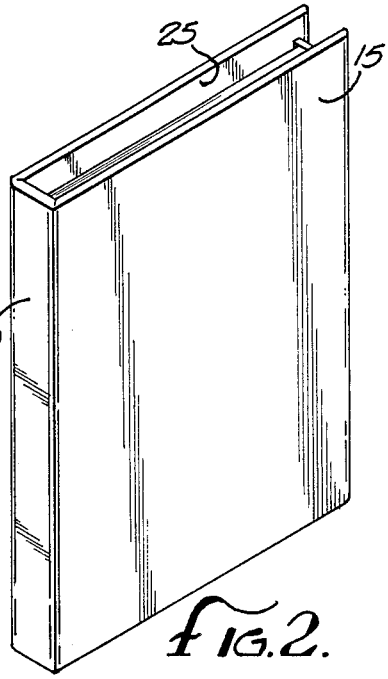
FIG. 2 is a perspective view of a preferred embodiment of the device according to the invention with the covers closed.

Turning now to FIG. 1 in the drawings, the preferred embodiment of the device for writing in the dark is indicated generally by reference number 10. The device has first and second covers 15 and 25 hingeably joined on either side of a back 20 so that the first and second covers may fold over against each other as in a book, in the manner shown in FIG. 2 in the drawings.

The device has a casing 28 attached to the second cover 25 which comprises, as seen from the outside, a box 30 and a lid 35. Lid 35 is hingeably joined to box 30 by pins 40. Lid 35 is shown lying against box 30 in the operating position of the device shown in FIG. 1 and lid 35 is shown swiveled away from box 30 in FIG. 3, exposing the interior of casing 28.

First cover 15, back 20, and second cover 25 may be formed from any suitable materials such as cardboard, particle board, aluminum sheeting, plastic, or the like, just as with the covers of a book or a clipboard. Lid 35 and box 30 may be conveniently formed from any metal or plastic, although an injection molded thermoplastic is believed to be the most inexpensive, lightweight, and durable choice and is preferred.

Lid 35 and box 30 are shown in FIG. 1 in the position they would have when the user employs the device in writing in the dark. Paper 50 is accessible through an opening or window 45 formed in lid 35. The user of the device can write directly on paper 50 through the window 45. An end 55 of the paper 50 protrudes from the device through second channel 105 defined by box 30 and lid 35. An on-off switch 80 is visible on the exterior of the lid 35 next to the window 45. Switch 80 controls the illumination means which supplies light to the paper 50 from underneath.

Figure 3:
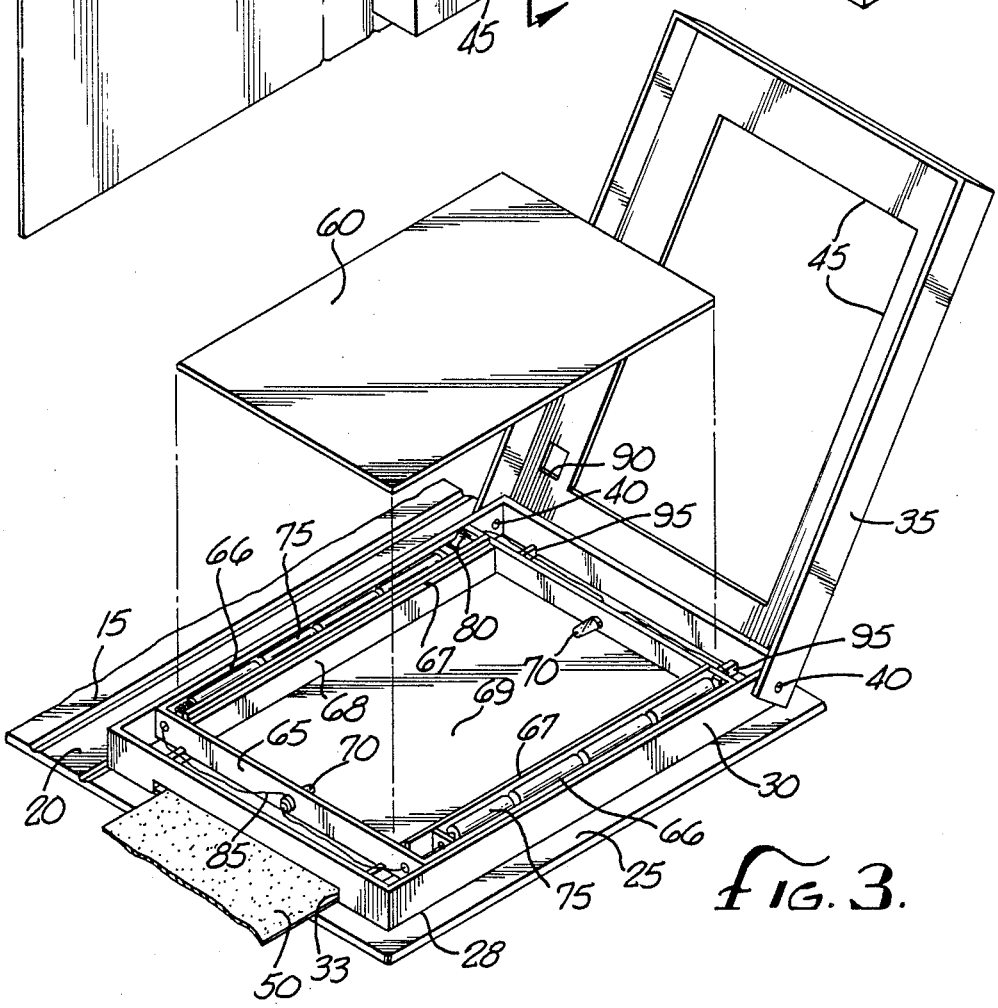
FIG. 3 is an exploded partial perspective view of the preferred embodiment of the device according to the invention with the translucent pane removed to show details of the illumination means.

Turning to FIG. 3 in the drawings, one may observe the details of the illumination means contained within the casing of the device. In FIG. 3, lid 35 is hinged away from box 30 on hinges 40. Translucent pane 60, which normally lies under lid 35 and forms the writing surface that backs paper 50 for writing, has been exploded upwards to reveal illumination tray 65, also preferably formed by injection molding from a thermoplastic. Translucent pane 60 may be made of any suitable material which can be formed into a pane and is transparent or semi-transparent to visible light; Lucite®, a commercial trademark for a plastic material which can be made semi-transparent, is preferred. Parallel lines may be printed on the translucent pane to guide the user's writing. The illumination tray 65 mounts two light bulbs 70 which are electrically powered by batteries 75 in series with on-off switch 80. Light from light bulbs 70 passes through translucent pane 60 and thence through paper 50 to the writer's eye.

Although the device is discussed in this specification as a device for writing, it is also a device for reading because the user can read notes or anything on single sheets of paper by holding them against the illuminated translucent pane.

Light bulbs 70 may be any of a number of light bulbs adapted for direct current use in flashlights; the batteries may be dry cell or flashlight batteries. In the embodiment shown in FIG. 3, eight AA penlight flashlight batteries are mounted in two groups of four between outer sides 66 and inner walls 67 of illumination tray 65.

Slot 33 in box 30 permits egress of paper 50 from the paper supply chamber located underneath illumination tray 65, to be described below in connection with FIGS. 4 and 5. Illumination tray 65 rests upon spacers 95 integrally formed in the bottom of box 30.

FIG. 4 illustrates how the various components of the casing of the device fit together during actual use. Lid 35 is shown nestled against box 30. Box 30 has sides 32 and bottom 34 which together define a first cavity 36 which is shown in FIG. 4 to be largely occupied by illumination tray 65 and paper 50 located between the illumination tray 65 and the bottom 34 of box 30. Paper 50 is shown folded within a paper supply chamber or means which is a second cavity 52. Second cavity 52 is defined between bottom 34 of box 30, sides 32 of box 30, bottom 69 of illumination tray 65, and spacers 95 (seen in FIGS. 3 and 5) formed in the bottom of box 30. The paper 50 exits second cavity 52 through slot 33 formed in box 30. Paper 50 is a continuous strip of paper folded in the manner of computer print-out paper so that a maximum amount of paper can be stored in the thin second cavity 52. Indeed, computer print-out paper is preferably used as the paper supply for the device. Such paper has the advantages of being lightweight, inexpensive, readily available, and prefolded.

To load paper 50 into second cavity 52, the lid 35 must be folded up as shown in FIG. 3 and translucent pane 60 removed from its position above illumination tray 65. Illumination tray 65 is then pulled up and out of box 30 which then exposes second cavity 52 to view and makes possible the loading of a new supply of paper 50. Once new paper has been added into second cavity 52, illumination tray 65 is put back into box 30, covering paper 50. Translucent pane 60 is then placed over the illumination tray. Lid 35 is then rotated about pins 40 into place against box 30. As may be noted from the foregoing, first cavity 36 is essentially defined by sides 32 and bottom 34 of box 30 and by lid 35, and second cavity 52 is a part of the first cavity which is next to bottom 34 of box 30.

FIG. 5 is another cross-sectional view of casing 28 which demonstrates how paper 50 is folded neatly in second cavity 52 below illumination tray 65. This cross-sectional view shows batteries 75 and shows how translucent pane 60 is supported by translucent pane rests 68 which are integrally formed in illumination tray 65. Paper 50 is pulled into place above translucent pane 60 and is accessible to the writer through window 45 formed in lid 35.

FIGS. 4 and 5 in the drawings, and particularly FIG. 4, show the path of the continuous strip of paper 50 from second cavity 52 to its exit from the casing near end 55 of the paper. The continuous strip of paper is folded flat within second cavity 52 and one end is pulled out and through slot 33 formed in box 30 and thence through a channel 100 defined by lid 35 and box 30. The continuous strip of paper 50 then passes between translucent pane 60 and lid 35 to emerge beneath window 45 and eventually leaves the device at channel 105 formed in lid 35.

To use the device, the user of the device loads a folded continuous strip of paper 50 into the second cavity 52 and replaces illumination tray 65 and translucent pane 60. The end of the paper 55 is then pulled out through slot 33 and folded back over the illumination tray 65 and translucent pane 60. It is then fed through channel 105 in lid 35. The lid 35 is then closed over box 30. The user pushes switch 80 in order to complete the circuit between the batteries 75 and light bulbs 70, which causes the filaments inside the light bulbs to become incandescent, filling the interior of the illumination tray 65 with light. This light escapes through translucent pane 60 and then through the paper to reach the eye of the user.

The amount of light that emerges, given the relatively low candle power of the illuminated light bulbs as well as the less than 100% light transmissibility of the translucent pane and the paper, will permit the user of the device to see the surface of paper 50 through window 45 in lid 35 well enough to read what is written on the paper and, in addition, to write upon that paper. However, the amount of light escaping from the device will not be enough to awaken a person sleeping nearby or otherwise be annoying to persons near the user of the device. Lid 35 covers box 30 in order to prevent the escape of any light except through window 45 in the lid.

The mounting of the casing 28 within first and second covers 15 and 25 causes the device to simulate a book, which is convenient for the user to carry and attractive as well. The device can be easily stored on a book shelf as if it were a book.

The illumination means of the preferred embodiment is by no means the only one that could be chosen. For example, electroluminescent sheeting or panelling might have been chosen in combination with a suitable alternating current conversion circuit to serve as a means of powering the electroluminescent panels. This would provide a thinner illumination means and thus a thinner device overall, although the power requirements are greater. Electroluminescent panelling is described in U.S. Pat. No. 4,266,164 to Schroeder (the specification of U.S. Pat. No. 4,266,164 is hereby incorporated by reference, as if it were disclosed herein in its entirety). Electroluminescent panels suitable for this invention are sold by Luminescent Systems, Inc. of Lebanon, N.H. Fluorescent tubes could also have been used in place of light bulbs, as disclosed in U.S. Pat. No. 4,184,194 to Shofu (the specification of U.S. Pat. No. 4,184,914 is hereby incorporated by reference, as if it were disclosed herein).

The device according to the invention may have other power sources than dry cell batteries. For example, power could be supplied by a jack from an external source, such as a small transformer/converter attached to the mains power supply or an automobile's 12 volt direct current electrical system. If the illumination means is electroluminescent panelling, an external power source (preferably alternating current) would be preferable due to the higher power requirements of this form of illumination.

In other variations, the casing could be used without the covers, abandoning the appearance and convenience of a book format. In another embodiment, the device could be attached to a clipboard-type backing. In yet a further embodiment, the device could be permanently or detachably mounted in an automobile or other vehicle, to be powered from the vehicle's internal electrical system. A preferred location for the device in this embodiment would be next to the driver, perhaps on the console or on an armrest.

Thus, a device for writing in the dark has been provided. Those skilled in the art will appreciate that the conception upon which this disclosure is based may be used as a basis for the designing of other structures, for carrying out the several purposes of the invention. The claims, therefore, should be regarded as including such equivalent constructions as do not depart from the spirit and scope of the invention, which is intended to be defined by the appended claims.

What is claimed is:

1. A device for writing in the dark, comprising:

a casing that is light-tight except for an opening formed in the casing;

illumination means mounted within the casing, the casing being adapted to allow light to emerge from the opening in the casing;

paper supply means for a continuous strip of paper located underneath the illumination means within the casing; and channel means for directing the continuous strip of paper from the paper supply means to and over the illumination means so that a user can write on a portion of the continuous strip of paper illuminated by the illumination means.

2. The device according to claim 1 further comprising first and second covers hingeably joined to permit the first cover to fold over the second cover, the casing being attached to the second cover and of sufficiently low height that it may be contained between the first cover and the second cover when the first cover is folded over the second cover.

3. The device according to claim 1 in which the illumination means comprises light-emitting means in circuit with electric power means.

4. The device according to claim 3 in which the light-emitting means comprises at least one light bulb.

5. The device according to claim 3 in which the light-emitting means comprises an electroluminescent panel.

6. The device according to claim 3 in which the electric power means comprises at least one battery.

7. A device for writing in the dark, comprising:

an open-faced box having a bottom and sides that define a first cavity;

illumination means adapted to be placed within the first cavity;

spacer means for separating the illumination means from the bottom of the box so that the box and illumination means define a second cavity that is a portion of the first cavity and is sized to contain and store a folded continuous strip of paper;

a lid detachably fastened to the box, the lid having an opening which is congruent with a substantial portion of the illumination means when the lid is fastened to the box and overlapping the box so that light cannot escape from the illumination means except through the opening;

a translucent pane which fits over the illumination means and under substantially all of the opening in the lid; and a first channel provided between the illumination means and the sides of the box to permit a continuous strip of paper stored in the second cavity to be drawn through the first channel and over the translucent pane under the opening in the lid.

8. The device according to claim 7 further comprising first and second covers hingeably joined to permit the first cover to fold over the second cover, the box and lid being of sufficiently low height when attached together that they may be contained between the first and second covers when the combination of box and lid is fastened to the second cover.

9. The device according to claim 7 further comprising a second channel formed in the lid or between the lid and the sides of the box for drawing the paper from the box and away from the device in order to be detached from the device when the user of the device has written on the paper through the opening in the lid.

10. The device according to claim 7 in which the illumination means is a removable tray containing at least one electric light-emitting means in circuit with electrical power means.

11. The device according to claim 10 in which the electric light-emitting means comprises at least one light bulb.

12. The device according to claim 10 in which the electrical power means comprises at least one battery.

13. A device for writing in the dark, comprising:

a rectangular open-faced box having a bottom and four sides that define a first cavity having the general form of a rectangular parallelopiped;

a rectangular lid hingeably attached to the box so that the lid can be rotated away from the box to expose the first cavity or rotated against the box to cover the first cavity, the lid being formed and adapted to fit into place over the first cavity so as to prohibit the exit of light from within the first cavity except through a rectangular window formed in the lid;

a rectangular illumination tray sized and adapted to be placed within the first cavity substantially underneath the window in the lid when the lid covers the first cavity, and spaced from the bottom of the box by spacer means interposed between the bottom of the box and the illumination tray thereby to form a second cavity defined by the illumination tray and the bottom and sides of the box, the second cavity having the general form of a thin rectangular parallelopiped and sized and adapted to hold and store a supply of a folded continuous strip of paper;

electric illumination means mounted in the illumination tray;

a translucent panel detachably mounted on the illumination tray and between the illumination tray and the window of the lid when the lid is in place on the box covering the first cavity so that the light emitted from the electric illumination means in the illumination tray passes through the translucent panel and thence through the window in the lid;

a first channel formed between the box and the lid to permit the continuous strip of paper to be drawn from the second cavity to above the illumination means and thence between the lid and the translucent panel so that the continuous strip of paper may be drawn between the translucent panel and the window for the user of the device to write on the paper strip; and second channel means formed in the lid or between the lid and the box permitting egress of the paper and allowing the paper strip to be drawn from the device and a portion thereof torn off.

14. The device according to claim 13 further comprising hingeably joined first and second covers, the box being attached to the second cover and the combination of the box and the lid being sized and adapted to permit the first cover to be folded over the second cover in the manner of a book.

15. The device according to claim 13 further comprising a slot formed in a side of the box for permitting egress of the paper strip from the second cavity into the first channel.

16. The device according to claim 13 in which the electric illumination means comprises at least one electric light-emitting means.

17. The device according to claim 16 in which the electric illumination means further comprises at least one battery and circuit means to supply electricity from the battery to the electric light-emitting means.

18. The device according to claim 17 comprising at least one on-off switch in the circuit between the electric light-emitting means and the battery in order to interrupt the circuit.

19. The device according to claim 18 in which the light-emitting means comprises at least one light bulb.

* * * * *